US006911138B2

(12) United States Patent
Motoki et al.

(10) Patent No.: US 6,911,138 B2
(45) Date of Patent: Jun. 28, 2005

(54) METHOD FOR PLATING ELECTRODES OF CERAMIC CHIP ELECTRONIC COMPONENTS

(75) Inventors: Akihiro Motoki, Fukui (JP); Shoichi Higuchi, Shiga-ken (JP); Yoshihiko Takano, Sabae (JP); Kunihiko Hamada, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 223 days.

(21) Appl. No.: 10/243,183

(22) Filed: Sep. 13, 2002

(65) Prior Publication Data

US 2003/0052014 A1 Mar. 20, 2003

(30) Foreign Application Priority Data

Sep. 13, 2001 (JP) ..... 2001-277817

(51) Int. Cl.[7] ..... C25D 3/60; C25D 3/30; C25D 3/32

(52) U.S. Cl. ..... 205/253; 205/300; 205/301; 205/302

(58) Field of Search ..... 361/305, 306.3, 361/321.2, 321.4, 321.5; 205/253, 300, 301, 302

(56) References Cited

U.S. PATENT DOCUMENTS 4,806,159 A * 2/1989 De Keyser et al. ..... 106/1.11
6,373,683 B1 * 4/2002 Higuchi et al. ..... 361/305
6,500,327 B1 * 12/2002 Saitoh et al. ..... 205/252
2002/0135972 A1 * 9/2002 Higuchi et al. ..... 361/321.2
2004/0066605 A1 * 4/2004 Trinh ..... 361/321.2

FOREIGN PATENT DOCUMENTS

| | | |
|---|---|---|
| JP | 10-72694 | 3/1998 |
| JP | 11-229174 | 8/1999 |
| JP | 2001-32099 | 2/2001 |
| JP | 2001-110666 | 4/2001 |
| JP | 2001-234387 | 8/2001 |
| JP | 2001-240993 | 9/2001 |

OTHER PUBLICATIONS

Copy of Japanese Examination Report dated Aug. 10, 2004 (and English translation of same).

* cited by examiner

*Primary Examiner*—Edna Wong
(74) *Attorney, Agent, or Firm*—Dickstein, Shapiro, Morin & Oshinsky, LLP.

(57) ABSTRACT

A method for plating electrodes of ceramic chip electronic components includes performing electroplating in a plating bath. The plating bath contains tin (II) sulfamate, acting as a tin (II) salt; a complexing agent including at least one selected from the group consisting of citric acid, gluconic acid, pyrophosphoric acid, heptoic acid, malonic acid, malic acid, salts of these acids, and gluconic lactone; and a brightener including at least one surfactant having an HLB value of about 10 or more. The tin plating adhesion of the resulting ceramic chip electronic components can be limited to a certain level.

19 Claims, 3 Drawing Sheets

METHOD FOR PLATING ELECTRODES OF CERAMIC CHIP ELECTRONIC COMPONENTS

BACKGROUND OF THE INVENTION

1. Field of the Invention

The present invention relates to methods for forming electrodes of ceramic chip electronic components. In particular, the present invention relates to a method for plating electrodes of ceramic chip electronic components and to a ceramic chip electronic component having electrodes plated by the method.

2. Description of the Related Art

Electrodes of electronic components formed of ceramics, glass, plastics and the like, are generally plated with a tin-lead alloy in order to improve the solder wettability thereof. Tin has been replacing the tin-lead alloy used to plate the electrodes as the desire for lead-free plating has intensified. However, the intrinsic physical properties of tin cause various problems in plating.

In particular, when ceramic chip electronic components (chips) containing ceramic and glass is subjected to tin plating, the chips are liable to adhere to one another. This adhesion is caused by, for example, tin plating using a well-known weakly acidic plating bath containing stannous sulfate.

This adhesion means that, as shown in FIGS. 1A to 1C, tin-plated portions (tin-deposited portion) 5 of at least two chips 1 adhere to each other during tin plating. It is considered that the adhesion is caused by the hardness of the tin plating film, which is softer than the tin-lead plating film.

In particular, when chips are subjected to barrel plating, each of the chips is agitated differently in the plating barrel. For example, the chips are in contact with adjacent chips for a long time in a region where chips are hardly agitated. As a result, these adjacent chips adhere to one another.

This adhesion problem becomes particularly significant when the number of chips to be plated at a time is increased. If the adhesion occurs, adhering chips themselves are defective. In addition, some weakly adhering chips are likely to be separated during plating or drying. The thickness of the plating films at the separated portions of these chips is very thin and, accordingly, these chips are defective. Thus, defective chips are likely to be mixed among normal chips.

In particular, when two chips 1 adhering to each other, as shown in FIG. 1A, separate, the thickness at the portions (separated portions 5*a*) of the plating films which adhered to each other become much smaller, as shown in FIG. 2. The thickness of the separated portions 5*a* measured in practice was, for example, 0.1 $\mu$m, and this thickness is much smaller than the thickness of 5 $\mu$m of normal tin-plating films 5.

Mounting characteristics, such as solderability, of chips having such a very thin plating film are degraded. As chip components become smaller, it is expected that this adhesion problem will become more serious.

In order to prevent the adhesion problem, processing conditions of chips have been improved. For example, the number of chips to be plated at a time is reduced to reduce the adhesion. However, in order to prevent the degradation of working efficiency and to advance lead-free tin plating, a fundamental solution is desired.

SUMMARY OF THE INVENTION

Accordingly, an object of the present invention is to provide a method for plating electrodes of ceramic chip electronic components in which the tin-plating adhesion is limited to a certain level and to provide a ceramic chip electronic component having electrodes plated by the method.

To this end, according to one aspect, the present invention provides a method for plating electrodes of ceramic chip electronic components. The method includes a step of performing electroplating in a plating bath. The plating bath contains tin (II) sulfamate, acting as a tin (II) salt; a complexing agent including at least one selected from the group consisting of citric acid, gluconic acid, pyrophosphoric acid, heptoic acid, malonic acid, malic acid, salts of these acids, and gluconic lactone; and a brightener including at least one surfactant having an HLB value of 10 or more.

By using tin (II) sulfamate as a tin salt, the ceramic chip electronic components can be subjected to lead-free tin plating to form tin-plated electrodes while the adhesion failure is remarkably reduced. This is because tin (II) sulfamate forms plating films which hardly adhere to one another due to the action of sulfamate ions, even if the plating films do not contain lead.

Preferably, the tin plating bath contains an antioxidant including at least one selected from the group consisting of hydroquinone, ascorbic acid, pyrocatechol, and resorcinol.

By adding the antioxidant to the tin plating bath, tin (II) ions in the plating bath can be prevented from oxidizing to tin (IV). Thus, the lifetime of the plating bath can be increased.

Preferably, the concentration of the tin (II) sulfamate is in the range of about 0.05 to 1.0 mol/L. The unit L represents one liter. By setting the concentration of the tin (II) sulfamate in this range, a smooth plating film having excellent solder wettability can be formed.

Preferably, the concentration of the complexing agent is in the range of about 0.05 to 10 mol/L. By setting the concentration of the complexing agent in this range, a stable complex can be produced from the tin and the complexing agent and, thus, a smooth plating film having excellent solder wettability can be formed in a wide range of electric current density.

Preferably, the concentration of the brightener is in the range of about 0.01 to 100 g/L.

By setting the concentration of the brightener in this range, the surfactant of the brightener forms a colloidal aggregation to significantly change the characteristics of the solution. This colloidal aggregation is formed when the surfactant sufficiently pervades the cathode (plated surface) and is present excessively in the plating bath. In other words, the formation of the colloidal aggregation means that a sufficient amount of the surfactant is present in the plating bath. Hence, the presence of the colloidal aggregation in the plating bath suggests that the cathode (plated surface) adsorbs a sufficient amount of the surfactant and, thus, forms a smooth plating film.

Preferably, the concentration of the antioxidant is in the range of about 0.01 to 100 g/L.

Preferably, the surfactant is a nonionic surfactant having at least one benzene ring in the molecular structure thereof. Thus, a tin plating film having excellent solder wettability can be formed in a wide range of electric current density. Preferably, the nonionic surfactant includes at least one selected from the group consisting of polyoxyethylene alkylphenyl ether, $\alpha$-naphthol ethoxylate, and $\beta$-naphthol ethoxylate.

Preferably, the pH of the plating bath is in the range of about 3 to 8. Thus, ceramic element assemblies of the ceramic chip components can be prevented from dissolving in the plating bath. Also, the formation of tin hydroxide which allows the plating bath to become clouded is prevented during cleaning after plating.

Preferably, the electroplating is performed by barrel plating using a plating barrel selected from the group consisting of a horizontal-rolling barrel, an inclined-rolling barrel, a vibrating barrel, and a shaking barrel.

Preferably, the size of the ceramic chip electronic components is about 5.7 mm×5.0 mm×4.0 mm or less.

According to another aspect, the present invention provides a ceramic chip electronic component comprising electrodes plated by the method described above. The resulting ceramic chip electronic component does not exhibit the adhesion failure and has excellent solder wettability.

DESCRIPTION OF THE PREFERRED EMBODIMENTS

A method for plating electrodes of ceramic chip electronic components of the present invention will now be described with reference to the drawings.

Figure 1C:
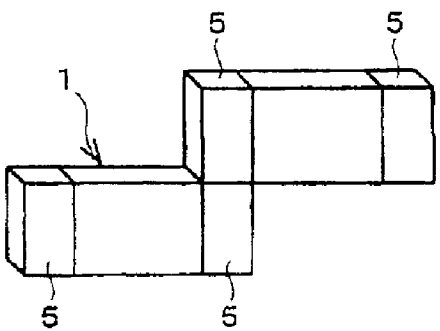
FIGS. 1A to 1C are perspective views showing adhesion of plating films.
Figure 1B:
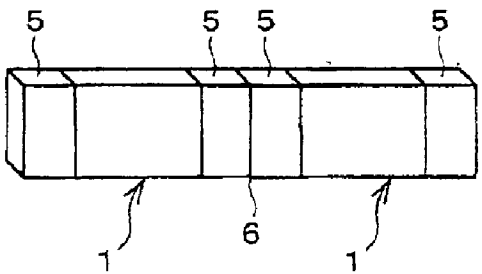
Figure 1A:
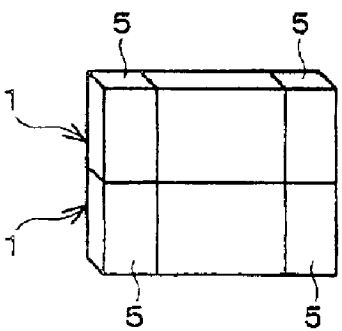
Figure 2:
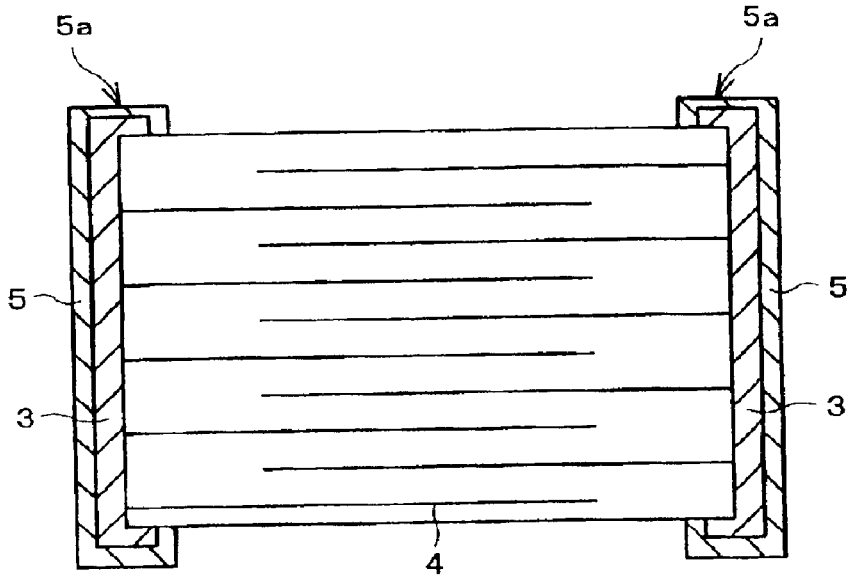
FIG. 2 is a sectional view of a ceramic chip electronic component.
Figure 3A:
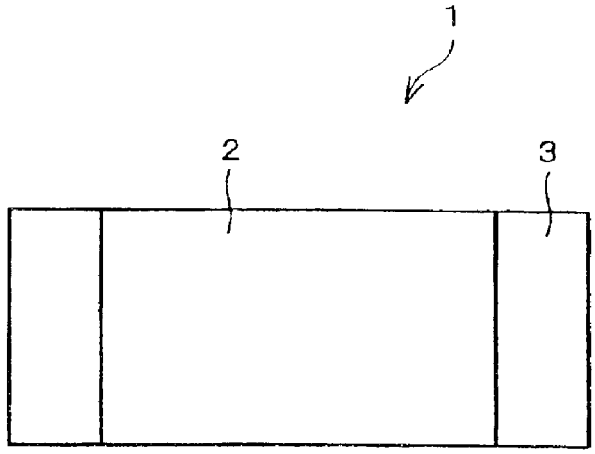
FIG. 3A is a plan view of a ceramic chip electronic component according to an embodiment of the present invention.
Figure 3B:
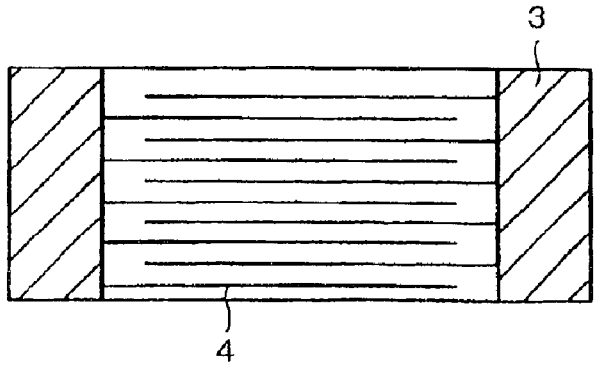
FIG. 3B is a sectional view of the ceramic chip electronic component shown in FIG. 3A.

As shown in FIG. 3A, a ceramic chip electronic component 1 comprises a substantially parallelepiped ceramic element assembly 2 and outer electrodes 3 at the ends in the longitudinal direction of the ceramic elemental assembly 2. The size of the ceramic chip electronic component 1 is, for example, 5.0 or 5.7 mm in width, 5.7 or 5.0 mm in length, and 4.0 mm in thickness. As shown in FIG. 3B, inner electrodes 4 are alternately deposited with ceramic layers therebetween, inside the ceramic elemental assembly 2. The number of the inner electrodes is arbitrary. In this embodiment, the outer electrodes 3 are electroplated using a tin plating bath to form plating films on the surface thereof. The outer electrodes 3 may be plated with nickel to form an underlayer before the tin plating.

The tin plating bath contains a tin (II) salt, a complexing agent, and a brightener. In the embodiment, tin (II) sulfamate is used as the tin (II) salt.

Preferably, the concentration of the tin (II) sulfamate in the plating bath is at least about 0.05 mol/L, and more preferably, it is about 0.1 mol/L or more. Preferably, the concentration of the tin (II) sulfamate in the plating bath is limited to about 1 mol/L, and more preferably to about 0.7 mol/L. This is because less than about 0.05 mol/L of tin (II) sulfamate increases surface asperity of plating films when electric current density is high, and more than about 1 mol/L of tin (II) sulfamate increases the surface asperity when the electric current density is low. The solder wettability of these plating films deteriorates significantly.

The complexing agent includes at least one selected from the group consisting of citric acid, gluconic acid, pyrophosphoric acid, heptoic acid, malonic acid, malic acid, salts of these acids, and gluconic lactone.

Preferably, the concentration of the complexing agent is at least about 0.05 mol/L, and more preferably, it is about 0.1 mol/L or more. Preferably, the concentration of the complexing agent is limited to about 10 mol/L, and more preferably to about 4.5 mol/L. This is because no stable complex is produced from the tin and the complexing agent if the molar ratio of the complexing agent to tin is less than 1. If no stable complex is formed, plating films having excellent solder wettability cannot be formed in a wide range of electric current density. Therefore, the concentration ratio of the complexing agent to the tin is preferably at least about 1. However, more than about 10 mol/L of the complexing agent does not dissolve in the plating bath.

The brightener includes at least one surfactant having a hydrophile-lipophile balance (HLB) value of about 10 or more. An HLB value represents the balance between the hydrophilicity and the lipophilicity of a surfactant. The HLB was devised by researchers of Atlas Powder Co. in the US, and it is now used as an index of the hydrophilicity of surfactants.

A surfactant, that is, the brightener, having an HLB value of less than about 10 does not dissolve in the plating bath having the above-described composition. The HLB value of the surfactant must be 10 or more.

More preferably, the brightener contains at least one nonionic surfactant having at least one benzene ring in the molecular structure thereof. Since the benzene ring has measurable adsorbability on a cathode (plated surface) in the electroplating, it is expected that the brightener is locally concentrated at the region to be plated. Thus, tin plating films having more increased solder wettability and hardly adhering to one another can be formed.

Preferably, the nonionic surfactant includes at least one selected from the group consisting of polyoxyethylene alkylphenyl ether, α-naphthol ethoxylate, and β-naphthol ethoxylate.

Preferably, the concentration of the brightener is at least about 0.01 g/L, and more preferably, it is about 0.1 g/L or more. Preferably, the concentration of the brightener is limited to about 100 g/L, and more preferably to about 10 g/L.

A brightener concentration of about 0.01 g/L is the critical micelle concentration of the surfactant of the brightener. Certain concentrations of the surfactant in a solution form a colloidal aggregation to significantly change the characteristics of the solution. This colloidal aggregation is referred to as a micelle, and the minimum concentration to form the micelle is referred to as a critical micelle concentration. On the other hand, more than about 10 g/L of the brightener is excessive and wasteful. Since the excess brightener does not affect plating characteristics, more than about 10 g/L of the brightener may be added, but more than about 100 g/L of the brightener does not dissolve in the plating bath. The micelle is formed when the surfactant sufficiently pervades the cathode (plated surface) and is present excessively in the plating bath. In other words, the formation of the micelle means that a sufficient amount of the surfactant is present in the plating bath. Hence, the presence of the micelle in the plating bath suggests that the cathode (plated surface) adsorbs a sufficient amount of the surfactant and, thus, forms a smooth plating film.

The plating bath may contain an antioxidant. The antioxidant contains at least one selected from the group consisting of hydroquinone, ascorbic acid, pyrocatechol, and resorcinol. By adding the antioxidant to the tin plating bath, tin (II) ions in the plating bath are prevented from oxidizing to tin (IV). Thus, the lifetime of the plating bath can be increased.

Preferably, the concentration of the antioxidant is at least about 0.01 g/L, and more preferably, it is about 0.1 g/L or more. This is because less than about 0.01 g/L of the antioxidant does not sufficiently inhibit the oxidization of tin. Preferably, the concentration of the antioxidant in the plating bath is limited to about 100 g/L, and more preferably to about 10 g/L. This is because more than about 10 g/L of the antioxidant is excessive and wasteful. Since the excess antioxidant does not affect plating characteristics, more than about 10 g/L of the antioxidant may be added, but more than 100 g/L of the antioxidant does not dissolve in the plating bath.

Preferably, the lower limit of pH of the plating bath is about 3, and more preferably about 3.5. This is because a plating bath of pH 2 or less is likely to increase the solubility of the ceramic element assembly 2, thus dissolving the ceramic element assembly 2. Preferably, the upper limit of pH of the plating bath is about 8, and more preferably about 7. This is because a plating bath of more than pH 9 produces tin hydroxide which allows the plating bath to become clouded when cleaning after plating. Therefore, the pH must be limited to the above-described ranges. In order to control the pH of the plating bath, a pH adjuster is used. When the pH is reduced, preferably, sulfamic acid, amidosulfonic acid, or sulfuric acid is used as the pH adjuster. When the pH is increased, any pH adjuster may be used.

Preferably, a conducting agent, such as sulfamic acid, sulfamate, sulfuric acid, or sulfate, is added to the plating bath, but it is not limited to these.

The plating may be performed with a plating barrel selected from the group consisting of a rolling barrel, a horizontal-rolling barrel, an inclined-rolling barrel, a vibrating barrel, and a shaking barrel.

Preferably, the size of the ceramic chip electronic components is about 5.7 mm×5.0 mm×4.0 mm or less. When the size of the ceramic chips is larger than about 5.7 mm×5.0 mm×4.0 mm, the adhesion is insignificant.

EXAMPLES

The present invention will be further illustrated with reference to examples. However, it is not limited to these examples, and the composition of the plating bath and plating conditions may be varied according to the above-described object.

The solder wettability and adhesion of plating films formed in the examples and comparative examples were evaluated according to the following methods.

The solder wettability of the plating films (particularly of elemental tin plating films) has a correlation with the surface state of the plating films, which is visually observed through the Hull cell test. Specifically, wettability required for chip electronic components is ensured by forming a layered tin plating film having a smooth surface.

Accordingly, plating films were formed in a Hull cell in the examples, and visually observed to determine whether the plating films satisfy the requirement for chip electronic components. A brass plate for the Hull cell test was used.

The Hull cell test was conducted without stirring at a current of 0.2 A for 25 min. At current densities in the range of 0.1 to 1.0 A/dm$^2$, the plating film was determined as very good when a lustrous plating film was formed on 100% of the cathode area; when the lustrous plating film was formed on 80% or more of the cathode area, the film was determined as good; and when the lustrous plating film was formed on less than 80% of the cathode area, the film was determined as not good.

The adhesion was evaluated by plating steel balls. The steel balls were plated with nickel, acting as an underlayer, and successively with tin using a rolling barrel under the following conditions. The current density was set higher than usual because the evaluation was conducted as an accelerated test for a short time.

The steel balls had a diameter of 1.2 mm, and 30 mL of the steel balls were plated in a rolling barrel having a volume of 100 mL at a rotation speed of 12 rpm.

The nickel plating was performed in a Watt bath at a temperature of 60° C. and a current density of 3 A/dm$^2$ for 60 mm; and the tin plating was performed at a temperature of 25° C. and a current density of 0.4 A/dm$^2$ for 120 min.

The evaluation value was derived from weights of the plated steel balls according to the following equation: adhesion ratio (%)=(weight (g) of adhering steel balls/total weight (g) of steel balls)×100. On the basis of this evaluation value, an adhesion ratio less than 10% was determined as good, and an adhesion ratio of 10% or more was determined as not good. The adhesion ratio in the evaluation of less than 10% represents the adhesion ratio in the mass production line of 0%.

Example 1

A method for plating electrodes of ceramic chip electronic components, according to the present invention, will now be concretely described with reference to the following examples and comparative examples.

Table 1 shows the compositions of plating baths used in Examples 1-1 to 1-5 and the evaluation results of the plating films formed in these plating baths.

TABLE 1

| | Plating bath | | | | | | Evaluation | |
|---|---|---|---|---|---|---|---|---|
| Example | Tin salt | Complexing agent | Conducting agent | Brightener | Antioxidant | pH | Adhesion ratio | Hull cell test |
| 1-1 | Tin (II) sulfamate 0.20 mol/L | Diammonium hydrogen citrate 1.50 mol/L | Sodium sulfamate 1.00 mol/L | Dimethylalkyl lauryl betaine 0.3 g/L | Pyrocatechol 1.0 g/L | 3.5 | good (7%) | good |
| 1-2 | Tin (II) sulfamate 0.40 mol/L | Malonic acid 1.20 mol/L | Sodium sulfamate 1.00 mol/L | β-naphthol ethoxylate 0.1 g/L | Hydroquinone 1.0 g/L | 4.0 | good (5%) | very good |
| 1-3 | Tin (II) sulfamate 0.10 mol/L | Heptoic acid 1.00 mol/L | Sodium sulfamate 2.00 mol/L | Polyoxyethylene octylphenyl ether 0.5 g/L | Ascorbic acid 1.0 g/L | 5.0 | good (6%) | very good |

TABLE 1-continued

| | Plating bath | | | | | | Evaluation | |
|---|---|---|---|---|---|---|---|---|
| Example | Tin salt | Complexing agent | Conducting agent | Brightener | Antioxidant | pH | Adhesion ratio | Hull cell test |
| 1-4 | Tin (II) sulfamate 0.70 mol/L | Gluconic acid 4.50 mol/L | Sulfamic acid 0.50 mol/L | Phenolsulfonic acid 0.3 g/L | Ascorbic acid 0.5 g/L | 7.0 | good (6%) | good |
| 1-5 | Tin (II) sulfamate 0.15 mol/L | Gluconic acid 1.0 mol/L | Sulfamic acid 0.50 mol/L | Polyoxyethylene nonylphenyl ether 1 g/L | Hydroquinone 0.5 g/L | 4.0 | good (4%) | very good |

Table 1 shows that each plating bath in Examples 1-1 to 1-5 exhibits good or very good results in both the adhesion ratio and the Hull cell test, and that it can form an excellent plating film.

Table 2 shows the compositions of plating baths used in Comparative Examples 1-1 to 1-5 and the evaluation results of the plating films formed in these plating baths.

TABLE 2

| | Plating bath | | | | | | Evaluation | |
|---|---|---|---|---|---|---|---|---|
| Comparative Example | Tin salt | Complexing agent | Conducting agent | Brightener | Antioxidant | pH | Adhesive ratio | Hull cell test |
| 1-1 | Tin (II) sulfate 0.20 mol/L | Diammonium hydrogen citrate 1.50 mol/L | Sodium sulfamate 1.00 mol/L | Dimethylalkyl lauryl betaine 0.3 g/L | Pyrocatechol 1.0 g/L | 3.5 | Not good (55%) | good |
| 1-2 | Tin (II) sulfate 0.40 mol/L | Malonic aicd 1.20 mol/L | Sodium sulfamate 1.00 mol/L | β-naphthol ethoxylate 0.1 g/L | Hydroquinone 1.0 g/L | 4.0 | Not good (49) | very good |
| 1-3 | Tin (II) fluoride 0.10 mol/L | Heptoic acid 1.00 mol/L | Sodium sulfamate 2.00 mol/L | Polyoxyethylene octylphenyl ether 0.5 g/L | Ascorbic acid 1.0 g/L | 5.0 | Not good (48%) | very good |
| 1-4 | Tin (II) oxide 0.70 mol/L | Gluconic acid 4.50 mol/L | Sulfamic acid 0.50 mol/L | Phenolsulfonic acid 0.3 g/L | Ascorbic acid 0.5 g/L | 7.0 | Not good (38%) | good |
| 1-5 | Tin (II) sulfate 0.15 mol/L | Gluconic acid 1.0 mol/L | Sulfamic acid 0.50 mol/L | Polyoxyethylene nonylphenyl ether 1 g/L | Hydroquinone 0.5 g/L | 4.0 | Not good (50%) | very good |

As shown in Table 2, tin (II) sulfamate was replaced with another tin salt in each of Comparative Examples 1-1 to 1-5 (the comparative example numbers correspond to the example numbers).

Table 2 shows that, as in Examples 1-1 to 1-5, Comparative Examples 1-1 to 1–5 exhibit good results in the Hull cell test, but the adhesion ratios are large and, therefore, determined as not good. In other words, in Comparative Examples 1-1 to 1-5, adhesion failure occurred.

According to the results of Examples 1-1 to 1-5 and Comparative Examples 1-1 to 1-5, it has been shown that using tin (II) sulfamate as a tin salt reduces the adhesion failure. This is because tin (II) sulfamate forms plating films which hardly adhere to one another due to the action of sulfamate ions.

The concentrations of tin (II) sulfamate in Examples 1-1 to 1-5 were in the range of 0.1 to 0.7 mol/L and this led to preferred results. However, the concentration of the tin (II) sulfamate is preferably in the range of about 0.05 to 1 mol/L. This is because, less than about 0.05 mol/L of tin (II) sulfamate increases the surface asperity of plating films when the electric current density is high, and more than about 1 mol/L tin (II) sulfamate increases the surface asperity when the electric current density is low. The solder wettability of these plating films deteriorates significantly.

The concentrations of the complexing agent were in the range of 1.00 to 4.50 mol/L and this led to preferred results. However, the concentration of the complexing agent is preferably in the range of about 0.05 to 10 mol/L. This is because a molar ratio of the complexing agent to tin of less than about 1 results in no stable complex and, therefore, preferred plating films exhibiting excellent solder wettability are not obtained over a wide range of current density. Hence, the concentration ratio of the complexing agent to the tin is preferably at least about 1. However, more than about 10 mol/L of the complexing agent does not dissolve in the plating bath.

The concentrations of the brightener were in the range of 0.1 to 0.5 g/L and led to preferred results. However, the concentration of the brightener is preferably at least about 0.01 g/L. Preferably, the concentration of the brightener is limited to about 100 g/L, and more preferably to about 10 g/L. A brightener concentration of about 0.01 g/L is the critical micelle concentration of the surfactant of the brightener. Certain concentrations of the surfactant in a solution form a colloidal aggregation to significantly change the characteristics of the solution. This colloidal aggregation is referred to as a micelle, and the minimum concentration to form the micelle is referred to as a critical micelle concentration. However, more than about 10 g/L of the brightener is excessive and wasteful. Since the excess brightener does not affect plating characteristics, more than about 10 g/L of the brightener may be added, but more than about 100 g/L of the brightener does not dissolve in the plating bath.

The concentrations of the antioxidant were in the range of 0.5 to 1.0 g/L and this led to preferred results. However, the concentration of the antioxidant is preferably at least about 0.01 g/L. This is because less than about 0.01 g/L of the antioxidant does not sufficiently inhibit the oxidization of tin. Preferably, the concentration of the antioxidant is limited to about 100 g/L, and more preferably to about 10 g/L. This is because more than 10 about g/L of the antioxidant is excessive and wasteful. Since the excess antioxidant does not affect plating characteristics, more than about 10 g/L of the antioxidant may be added. However, more than about 100 g/L of the antioxidant does not dissolve in the plating bath.

The pHs of the plating baths were in the range of 3.5 to 7 and this led to preferred results. However, the pHs of the plating baths are preferably in the range of about 3 to 8. This is because a plating bath of pH 2 or less is likely to increase the solubility of the ceramic element assembly, thus dissolving the ceramic element assembly. Also, a plating bath of more than pH 9 produces tin hydroxide which allows the plating bath to become clouded in cleaning after plating. Therefore, the pH must be limited to the above-described ranges. In order to control the pH of the plating bath, a pH adjuster is used. When the pH is reduced, preferably, sulfamic acid, amidosulfonic acid, or sulfuric acid is used as the pH adjuster. When the pH is increased, any pH adjuster may be used.

Preferably, a conducting agent, such as sulfamic acid, sulfamate, sulfuric acid, or sulfate, is added to the plating bath, but it is not limited to these.

The plating may be performed with a plating barrel selected from the group consisting of a rolling barrel, a horizontal-rolling barrel, an inclined-rolling barrel, a vibrating barrel, and a shaking barrel.

Preferably, the size of the ceramic chip electronic components is about 5.7 mm×5.0 mm×4.0 mm or less. When the size of the ceramic chips is larger than about 5.7 mm×5.0 mm×4.0 mm, the adhesion is insignificant.

Example 2

In order to obtain a lustrous plating film, the kinds of the brightener were varied and evaluated according to the above-described criteria. Since it has already been known that the compositions in Table 1 lead to preferred results, the brightener evaluation was performed based on Example 1-1. Specifically, the brightener of Example 1-1 was replaced with the brighteners of Examples 2-1 to 2-5 shown in Table 3 to prepare the plating baths of Examples 2-1 to 2-5. The pH was set at 5.

Table 3 shows that each plating bath in Examples 2-1 to 2-5 exhibits good or very good results in both the adhesion ratio and the Hull cell test. In particular, Examples 2-2 and 2-3 were determined as very good. The brighteners of these two Examples were nonionic surfactants having at least one benzene ring in the molecular structure thereof. Solder wettability as well as anti-adhesion is required for the plating films formed in the electroplating bath. Accordingly, a plating bath shown in Table 3 determined as very good in the Hull cell test is preferably used. Specifically, the brightener preferably contains a nonionic surfactant having at least one benzene ring in the molecular structure thereof.

The concentration of tin (II) sulfamate was 0.2 mol/L in Examples 2-1 to 2-5. However, the concentration of the tin (II) sulfamate is preferably about 0.05 mol/L or more, and more preferably about 0.1 mol/L or more. This is because less than about 0.05 mol/L of tin (II) sulfamate increases surface asperity of plating films when electric current density is high, and more than about 1 mol/L of tin (II) sulfamate increases the surface asperity when the electric current density is low. The solder wettability of these plating films deteriorates significantly.

The concentration of the complexing agent in the plating bath was 1.50 mol/L. However, the concentration of the complexing agent is preferably in the range of about 0.05 to 10 mol/L. This is because a molar ratio of the complexing agent to tin of less than about 1 results in no stable complex and, therefore, preferred plating films exhibiting excellent solder wettability are not obtained in a wide range of current density. Therefore, the concentration ratio of the complexing agent to the tin is preferably at least about 1. However, more than about 10 mol/L of the complexing agent does not dissolve in the plating bath.

The concentration of the brightener in the plating bath was 0.3 g/L. However, the concentration of the brightener is preferably at least about 0.01 g/L. Preferably, the concentration of the brightener is limited to about 100 g/L, and more preferably to about 10 g/L. A brightener concentration of about 0.01 g/L is the critical micelle concentration of the brightener, which also serves as a surfactant. A specific concentration or more of the brightener in a solution forms a colloidal aggregation to significantly change the characteristics of the solution. This colloidal aggregation is referred to as a micelle, and the minimum concentration to form the micelle is referred to as a critical micelle concentration. More than about 10 g/L of the brightener is excessive and wasteful. Since the excess brightener does not affect

TABLE 3

| | Plating bath | | | | | | Evaluation | |
|---|---|---|---|---|---|---|---|---|
| Example | Tin salt | Complexing agent | Conducting agent | Brightener | Antioxidant | pH | Adhesion ratio | Hull cell test |
| 2-1 | Tin (II) sulfamate 0.20 mol/L | Diammonium hydrogen citrate 1.50 mol/L | Sodium sulfamate 1.00 mol/L | Polyoxyethylene alkylpropylenediamine 0.3 g/L | Pyrocatechol 1.0 g/L | 5.0 | Good (4%) | good |
| 2-2 | | | | α-naphthol ethoxylate 0.1 g/L | | | Good (6%) | very good |
| 2-3 | | | | Polyoxyethylene nonylphenyl ether 0.3 g/L | | | Good (7%) | very good |
| 2-4 | | | | α-naphthol ethoxylate 0.3 g/L | | | Good (3%) | good |
| 2-5 | | | | Polyoxyethylene dodecylamine 0.3 g/L | | | Good (5%) | good |

plating characteristics, more than about 10 g/L of the brightener may be added, but more than about 100 g/L of the brightener does not dissolve in the plating bath.

The concentration of the antioxidant in the plating bath was 1.0 g/L. However, the concentration of the antioxidant is preferably at least about 0.01 g/L. This is because less than about 0.01 g/L of the antioxidant does not sufficiently inhibit the oxidization of tin. Preferably, the concentration of the antioxidant is limited to about 100 g/L, and more preferably to about 10 g/L. This is because more than about 10 g/L of the antioxidant is excessive and wasteful. Since the excess antioxidant does not affect plating characteristics, more than about 10 g/L of the antioxidant may be added. However, more than about 100 g/L of the antioxidant does not dissolve in the plating bath.

The pH of the plating baths was set at 5.0. However, the pH of the plating baths is preferably in the range of about 3 to 8. This is because a plating bath of pH 2 or less is likely to increase the solubility of the ceramic element assembly, thus dissolving the ceramic element assembly. Also, a plating bath of more than pH 9 produces tin hydroxide which allows the plating bath to become clouded in cleaning after plating. Therefore, the pH must be limited to the above-described range. In order to control the pH of the plating bath, a pH adjuster is used. When the pH is reduced, preferably, sulfamic acid, amidosulfonic acid, or sulfuric acid is used as the pH adjuster. When the pH is increased, any pH adjuster may be used.

Preferably, a conducting agent, such as sulfamic acid, sulfamate, sulfuric acid, or sulfate, is added to the plating bath, but it is not limited to these.

The plating may be performed with a plating barrel selected from the group consisting of a rolling barrel, a horizontal-rolling barrel, an inclined-rolling barrel, a vibrating barrel, and a shaking barrel.

Preferably, the size of the ceramic chip electronic components is about 5.7 mm×5.0 mm×4.0 mm or less. When the size of the ceramic chips is larger than about 5.7 mm×5.0 mm×4.0 mm, the adhesion is insignificant.

According to the present invention, plating films can be formed on the electrodes of the chip components while the adhesion failure is remarkably reduced, regardless of the chip size by using tin (II) sulfamate as a tin salt to plate ceramic chip components. This is because tin (II) sulfamate forms plating films which hardly adhere to one another due to the action of sulfamate ions. Also, by using a nonionic surfactant having at least one benzene ring in the molecular structure thereof as a brightener, a tin plating film having excellent solder wettability can be formed in a wide range of current density.

What is claimed is:

1. A method for forming electrodes of ceramic chip electronic components, comprising electroplating the chip components in a plating bath comprising: a metal salt; a complexing agent comprising at least one member selected from the group consisting of citric acid, gluconic acid, pyrophosphoric acid, heptoic acid, malonic acid, malic acid, salts of these acids and gluconic lactone; a brightener comprising at least one surfactant having an HLB value of about 10 or more; and a conducting agent selected from the group consisting of sulfamic acid and sodium sulfamate; wherein said metal salt consists essentially of tin (II) sulfamate, acting as a tin (II) salt.

2. A method for forming electrodes of ceramic chip electronic components according to claim 1, wherein the plating bath further comprises an antioxidant which is at least one member selected from the group consisting of hydroquinone, ascorbic acid, pyrocatechol and resorcinol.

3. A method for forming electrodes of ceramic chip electronic components according to claim 2, wherein the concentration of the tin (II) sulfamate is in the range of about 0.05 to 1.0 mol/L.

4. A method for forming electrodes of ceramic chip electronic components according to claim 3, wherein the concentration of the complexing agent is in the range of about 0.05 to 10 mol/L.

5. A method for forming electrodes of ceramic chip electronic components according to claim 4, wherein the concentration of the brightener is in the range of about 0.01 to 100 g/L.

6. A method for forming electrodes of ceramic chip electronic components according to claim 5, wherein the concentration of the antioxidant is in the range of about 0.01 to 100 g/L.

7. A method for forming electrodes of ceramic chip electronic components according to claim 6, wherein the surfactant is a nonionic surfactant having at least one benzene ring in the molecular structure thereof.

8. A method for forming electrodes of ceramic chip electronic components according to claim 7, wherein the nonionic surfactant comprises at least one member selected from the group consisting of polyoxyethylene alkyiphenyl ether, α-naphthol ethoxylate and β-naphthol ethoxylate.

9. A method for forming electrodes of ceramic chip electronic components according to claim 8, wherein the pH of the plating bath is in the range of about 3 to 8.

10. A method for forming electrodes of ceramic chip electronic components according to claim 9, wherein the electroplating is performed by barrel plating.

11. A method for forming electrodes of ceramic chip electronic components according to claim 10, wherein the size of the ceramic chip electronic components is about 5.7 mm=5.0 mm=4.0 mm or less.

12. A method for forming electrodes of ceramic chip electronic components according to claim 11, wherein the concentration of the tin (II) sulfamate is in the range of about 0.1 to 0.7 mol/L; the concentration of the complexing agent is in the range of about 0.1 to 4.5 mol/L; the concentration of the brightener is in the range of about 0.1 to 10 g/L; the concentration of the antioxidant is in the range of about 0.1 to 10 g/L; and the pH is about 3.5 to 7.

13. A method for forming electrodes of ceramic chip electronic components according to claim 1, wherein the concentration of the tin (II) sulfamate is in the range of about 0.05 to 1.0 mol/L.

14. A method for forming electrodes of ceramic chip electronic components according to claim 1, wherein the concentration of the complexing agent is in the range of about 0.05 to 10 mol/L.

15. A method for forming electrodes of ceramic chip electronic components according to claim 1, wherein the concentration of the brightener is in the range of about 0.01 to 100 g/L.

16. A method for forming electrodes of ceramic chip electronic components according to claim 2, wherein the concentration of the antioxidant is in the range of about 0.01 to 100 g/L.

17. A method for forming electrodes of ceramic chip electronic components according to claim 1, wherein the surfactant is a nonionic surfactant having at least one benzene ring in the molecular structure thereof.

18. A method for forming electrodes of ceramic chip electronic components according to claim 1, wherein the pH of the plating bath is in the range of about3 to 8.

19. A method for forming electrodes of ceramic chip electronic components according to claim 1, wherein the electroplating is performed by barrel plating.

* * * * *